United States Patent [19]

Collins

[11] Patent Number: 4,545,358

[45] Date of Patent: Oct. 8, 1985

[54] CROSSBOW

[75] Inventor: Anthony J. Collins, Bridgnorth, England

[73] Assignee: B & P Barnett Limited, England

[21] Appl. No.: 522,583

[22] Filed: Aug. 12, 1983

[30] Foreign Application Priority Data

Dec. 17, 1982 [GB] United Kingdom ..... 8235967

[51] Int. Cl.[4] ..... F41B 5/00

[52] U.S. Cl. ..... 124/88; 124/25

[58] Field of Search ..... 124/25, 23 R, 24 R, 124/88, 22

[56] References Cited

U.S. PATENT DOCUMENTS 3,224,427 12/1965 Ronan ..... 124/25

3,957,027 5/1976 Drake ..... 124/88

FOREIGN PATENT DOCUMENTS 867920 4/1971 Canada ..... 124/23 R

*Primary Examiner*—Richard T. Stouffer

*Attorney, Agent, or Firm*—Berman, Aisenberg & Platt

[57] ABSTRACT

A crossbow has a prod in two parts, each of which is pivotally connected with the stock so that the prod parts can lie alongside the stock when the bow is not in use. When the bow is prepared for use, the prod parts are clamped in operative positions by a mechanism which includes a handle and which provides a substantial mechanical advantage to the operator.

2 Claims, 3 Drawing Figures

CROSSBOW

BACKGROUND OF THE INVENTION

This invention relates to a crossbow comprising a prod and a stock having a fore-end portion on which the prod is supported. When the bow is in use, a bow string is connected to the prod adjacent to opposite ends thereof to extend across the stock, the prod extending transversely of the stock. The combination of prod and stock, without a string, is called herein a crossbow.

SUMMARY OF THE INVENTION

According to the present invention, there is provided a crossbow wherein the prod is arranged for swinging relative to the stock whilst remaining connected with the stock, whereby the configuration of the bow can be changed between a configuration in which the bow is used and a more compact configuration.

It is known to mount the prod of a crossbow releasably in the stock so that the bow can be dis-assembled to achieve a compact configuration. However, known means for mounting the prod in the stock does not enable the crossbow to be dis-assembled and re-assembled conveniently and known crossbows are normally transported and stored between periods of use in an assembled condition. A crossbow in accordance with the present invention can conveniently be changed from its configuration of use to a more compact configuration and returned to its configuration of use.

While the entire prod may swing as a unit relative to the stock, it is preferred that the prod be in two relatively movable parts, which parts can swing relative to the stock and relative to each other whilst remaining connected with the stock. The arrangement may be such that opposite end portions of the prod can swing towards each other to relieve the tension in a bow string, when connected to the prod.

In a case where each part of the prod can swing from a position in which it is approximately perpendicular to the stock to a position in which it is approximately parallel to the stock, movement throughout a major part of the range of swinging can conveniently be effected by the user applying force directly to each part of the prod by hand. However, a final part of the swinging movement into the configuration of use establishes tension in a string attached to opposite end portions of the prod and flexing of the prod. Thus, the preferred crossbow comprises a mechanism for transmitting force with a mechanical advantage from a handle of the mechanism to the parts of the prod to swing said parts into respective positions relative to the stock which are occupied when the bow is in use.

BRIEF DESCRIPTION OF THE DRAWINGS

An example of a crossbow embodying the invention will now be described, with reference to the accompanying drawings, wherein.

DETAILED DESCRIPTION

Figure 1:
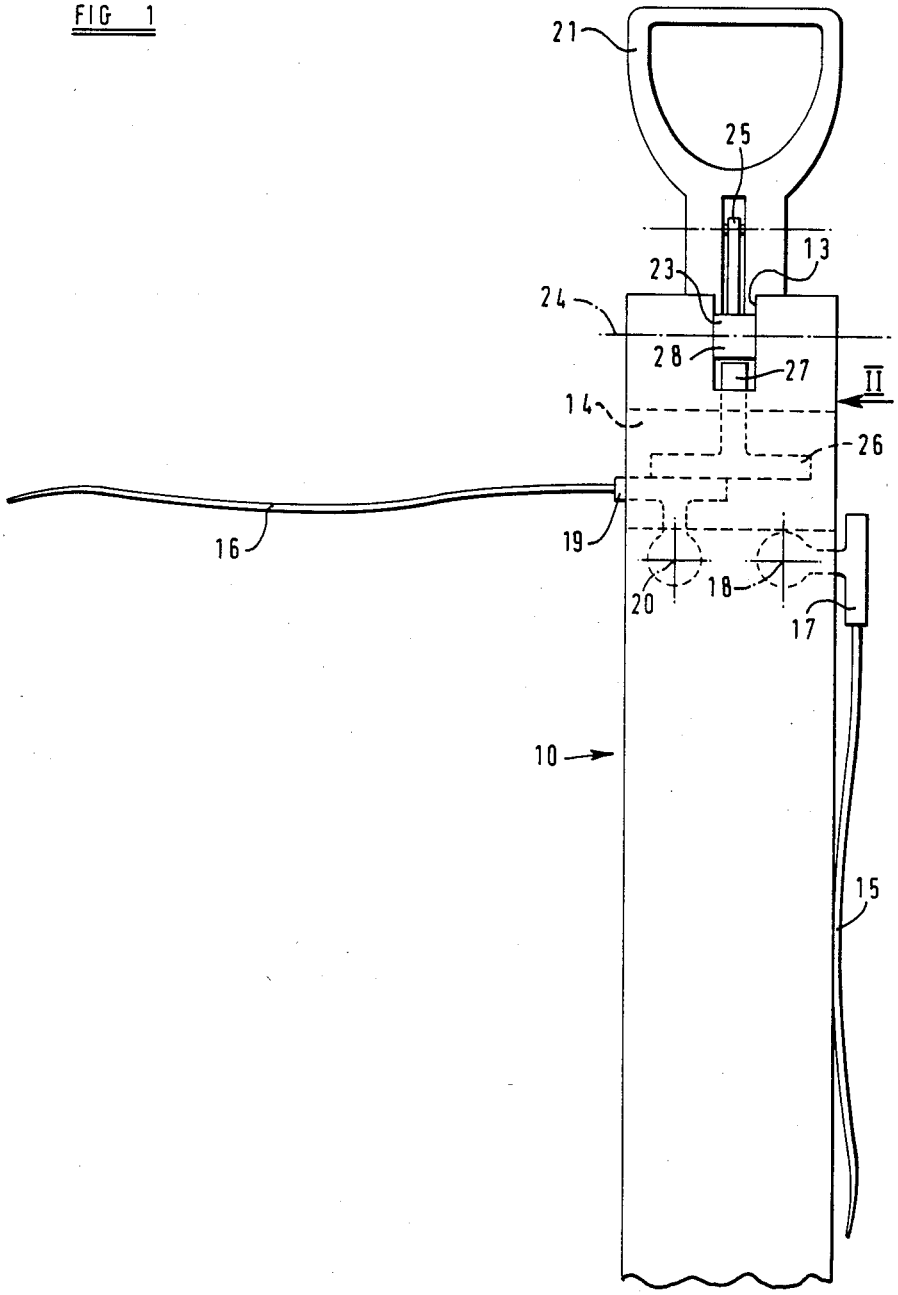
FIG. 1 shows an underneath plan view of a part of the crossbow including a fore-end portion of the stock and the bow prod.

The crossbow comprises an elongated stock, only a fore-end portion 10 of which is illustrated in the drawing. The remainder of the stock may be of known form and include a butt. The remainder of the stock carries a trigger mechanism (not shown) arranged in a known manner. An upper surface 11 of the stock constitutes a guide surface for guiding a bolt (not shown) when the bolt is fired from the crossbow in a known manner. In the guide surface, there is provided a rectilinear groove 12 in which the bolt can slide. Adjacent to its free end, there is a formed in the fore-end portion 10 a slot 13 which extends downwardly from the groove 12 to the underside of the stock. A laterally extending aperture 14 is formed in the fore-end portion at a position spaced somewhat towards the butt from the slot 13, this aperture opening at opposite side faces of the stock but being closed from the guide surface 11 and from the underside of the stock.

On the fore-end portion 10 there is supported a bow prod formed in two identical parts 15 and 16. One end portion of the prod part 15 is engaged in a shoe 17 mounted in the fore-end portion 10 for pivoting about an axis 18 which is perpendicular to the guide surface 11. An end portion of the prod part 16 is received in a similar shoe 19 mounted for pivoting relative to the stock about an axis 20. The axis 18 and 20 are parallel to each other, spaced apart laterally of the stock to lie on opposite sides of the groove 12 and are spaced from the aperture 14 somewhat in a direction away from the free end of the fore-end portion 10.

It will be seen that the prod parts 15 and 16 can swing independently of each other relative to the stock between a first position occupied by the part 15 in FIG. 1, in which the shoe 17 lies outside the aperture 14 and the prod part 15 is approximately parallel to the length of the stock, so that the prod part contacts the stock at a position remote from the shoe 17, and a second position occupied by the prod part 16 in FIG. 1, in which the prod part extends approximately at right angles to the length of the stock and the shoe 19 lies partly within the aperture 14.

It will be understood that, when the bow is in use, both of the prod parts 15 and 16 would occupy their second positions. In this configuration, the crossbow is somewhat cumbersome. For transport and storage of the crossbow between periods of use, the two prod parts would be moved to their first positions to provide a relatively compact configuration of the crossbow.

Each prod part 15, 16 may be releasably mounted in its shoe 17, 19. Alternatively, the prod parts may be permanently secured in their shoes, the shoes being removed from the fore-end portion 10 if it is required to substitute a new prod for the prod originally mounted on the fore-end portion.

For establishing and maintaining the second positions of the prod parts, there is provided a clamping mechanism which is mounted on the fore-end portion 10 of the stock. The clamping mechanism comprises a handle 21 which, in the particular example illustrated, has the form of stirrup. This handle is mounted for pivoting relative to the fore-end portion about an axis 22 which, when the crossbow is in use, lies below the aperture 14 and is generally horizontal. The mechanism further comprises a lever 23 mounted for pivoting on the fore-end portion 10 about an axis 24 parallel to the axis 22, spaced somewhat further from the guide surface 11 than is the axis 22 and spaced somewhat further from the butt of the crossbow than is the axis 22. For transmitting force between the handle 21 and the lever 23, there is provided a strut 25 pivoted adjacent to one of its ends on the handle 21 at a position between the axis 22 and a free end of the handle and the strut being pivoted adjacent to its other end on the lever 23 at a position between the axis 24 and a free end of the lever. The handle 21, strut 25 and lever 23 together constitute a toggle linkage which provides a large mechanical advantage to the handle as the strut becomes aligned with the handle.

The clamping mechanism further comprises a pressure plate 26 disposed within the aperture 14 and guided for rectilinear movement relative to the fore-end portion 10 along the length of the stock. A guide pin 27 extends from the pressure plate 26 into the slot 13. On the end portion of the lever 23 remote from the axis 24, there is provided an adjustable abutment 28 which, by pivoting of the handle 21, can be moved into the slot 13 and engaged with the guide pin 27 to urge the pressure plate in a direction away from the free end of the fore-end portion 10. It will be seen that the clamping mechanism provides a considerable mechanical advantage to a user who grasps an end portion of the handle 21 remote the axis 22, so that a user can apply a relatively large force to the pressure plate.

Figure 3:
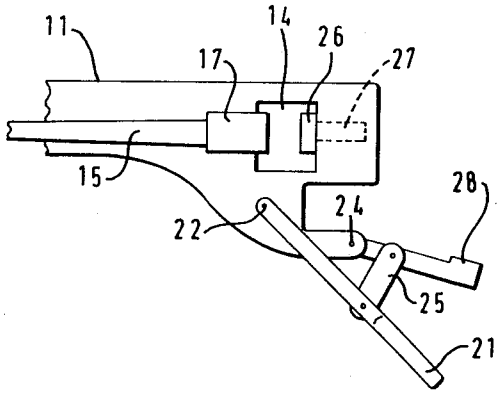
FIG. 3 shows on a reduced scale a side elevation similar to FIG. 2 but showing a clamping mechanism of the crossbow in released position.

When the handle 21 is pivoted to the position illustrated in FIG. 3, the abutment 28 is withdrawn from the slot 13 and the pressure plate 26 can move within the aperture 14 away from the shoes 17 and 19. The prod parts 15 and 16 can then be swung from their second positions to their first positions.

Even if a bow string (not shown) is connected between the free ends of the prod parts 15 and 16, these can easily be moved by application of force to the prod parts directly by the hands of a user through a major part of their travel from the first position to the second position. In this way, the shoes 17 and 19 can be reintroduced into the aperture 14 to lie just to the rear of the pressure plate 26. If the handle 21 is then pivoted by the user towards the position illustrated in FIG. 2, the abutment 28 is driven along the slot 13 to force the pressure plate 26 against shoes 17 and 19 so that pivoting of the shoes is continued until the prod parts occupy their second position.

As the prod parts 15 and 16 move into their second positions, the strut 25 moves into or through a central position by which we mean a position in which the axis of the pivotal connection between the strut and the lever 23 lies in a plane containing the axis 22 and the axis of the pivotal connection between the strut and the handle 21. An abutment may be provided on one of the handle 21 and lever 23 to engage the strut and limit movement of the strut when this central position has been reached or has just been passed. It will be seen that, when the lever 23 is in the position shown in FIG. 2, any force exerted on the pressure plate 26 by the shoes 17 and 19 does not tend to pivot the handle 21 from the position shown in FIG. 2 towards the position shown in FIG. 3.

Figure 2:
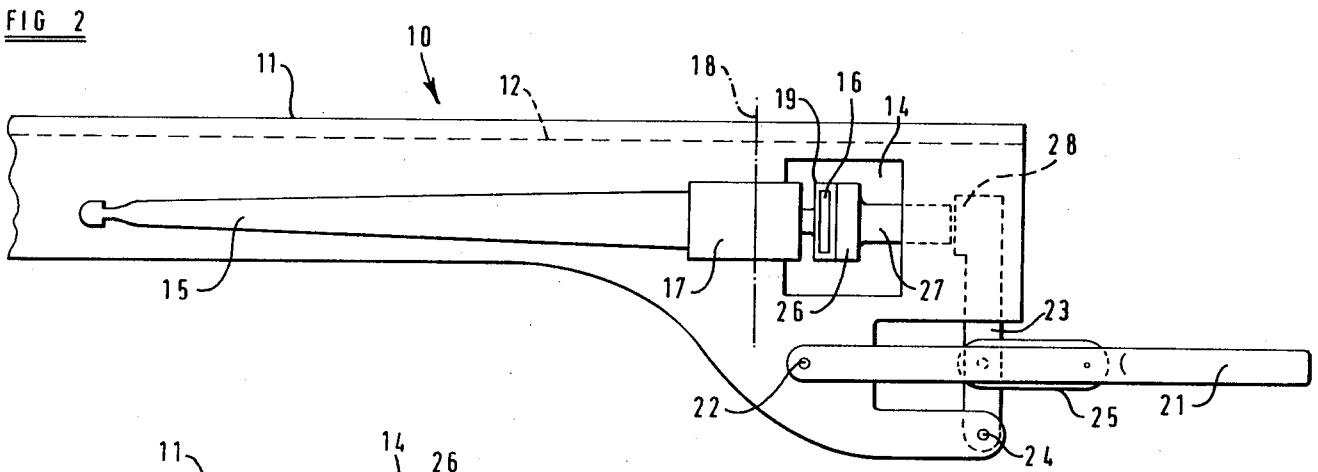
FIG. 2 shows a side elavation on the arrow II of FIG. 1.

In a case where, during clamping of the prod parts 15 and 16 in their second positions, the strut 25 moves through the central position, pivoting of the handle 21 from the position shown in FIG. 2 towards the position shown in FIG. 3 will initially increase the stress in the strut 25 and lever 23 and will therefore be opposed by the force exerted on the pressure plate 26 by the shoes 17 and 19. Thus, the handle will normally be held releasably in the position shown in FIG. 2. In a case where the strut 25 moves to, but not beyond, the central position a releasable fastener may be provided for holding the handle 21 in the position shown in FIG. 2.

It will be noted that, in the position shown in FIG. 2, the handle 21 projects beyond the fore-end portion 10 in a direction away from the butt of the stock. The handle is conveniently formed as a stirrup into which a user can insert his foot to hold the stock during cocking of the bow. During clamping of the prod parts 15 and 16 in their second positions, the handle 21 is used as a lever. When used for this purpose and when used to hold the stock during cocking, a moderately long handle is more convenient than is a short handle.

In the particular example of stock illustrated, the two parts of the prod can swing relative to each other so that respective free ends move towards and away from each other. This results in the tension in the bow string being relieved when the parts of the prod move from their respective positions of use. Tension must be reestablished in the string before subsequent use of the crossbow. In an alternative arrangement, the bow prod comprises a single piece, to opposite end portions of which the bow string is attached, and this piece can swing relative to the stock, for example pivoting about an axis which extends through the groove 12. By such pivoting, the distance to which the prod extends transversely from the stock can be reduced without relieving the tension in the bow string but the length of the crossbow may be increased somewhat by such swinging of the prod.

I claim:

1. A crossbow comprising a prod which is formed in two relatively movable parts, a stock having a fore-end portion, means for mounting said parts on the fore-end portion for swinging relative to the stock and relative to each other while remaining connected with the stock and a mechanism which includes:

(a) a single pressure member which acts on both of said prod parts to exert thereon force transmitted by said mechanism and (b) a handle connected to said pressure member, said mechanism being for transmitting force with a mechanical advantage from the handle through the pressure member to the prod parts to swing the prod parts into respective positions relative to the stock, which positions are occupied when the bow is in use, and wherein the mechanical advantage provided by said mechanism increases during swinging of said prod parts of the prod into said positions.

2. A crossbow comprising a prod which is formed in two relatively movably parts, a stock having a fore-end portion, means for mounting said parts on the fore-end portion for swinging relative to the stock and relative to each other while remaining connected with the stock and a mechanism which includes:

(a) a handle connected with the stock by a pivot defining a pivot axis and (b) element means which, during the use of the crossbow, acts on the handle radially of the pivot axis to transmit to the handle force which results from application to the prod parts of a bending load, said mechanism being for transmitting force with a mechanical advantage from the handle to the prod parts to swing the prod parts into respective positions relative to the stock, which positions are occupied when the bow is in use, and wherein the mechanical advantage provided by said mechanism increases during swinging of said parts of the prod into said positions, said prod parts swinging substantially in a common plane which is parallel to the pivot axis of the handle.

* * * * *